US008690546B2

(12) United States Patent
Standke

(10) Patent No.: US 8,690,546 B2
(45) Date of Patent: Apr. 8, 2014

(54) AUXILIARY SYSTEM FOR A DRIVE DEVICE

(76) Inventor: Edward J. Standke, Pawling, NY (US)

( * ) Notice: Subject to any disclaimer, the term of this patent is extended or adjusted under 35 U.S.C. 154(b) by 260 days.

(21) Appl. No.: 13/113,486

(22) Filed: May 23, 2011

(65) Prior Publication Data

US 2011/0286863 A1 Nov. 24, 2011

Related U.S. Application Data

(60) Provisional application No. 61/346,977, filed on May 21, 2010.

(51) Int. Cl.
*F04B 35/00* (2006.01)
*F16B 31/00* (2006.01)

(52) U.S. Cl.
USPC ..... 417/319; 417/362; 464/151

(58) Field of Classification Search
USPC ..... 417/319, 362; 464/151, 161, 162
See application file for complete search history.

(56) References Cited

U.S. PATENT DOCUMENTS 3,200,665 A * 8/1965 Wells ..... 74/446
5,219,273 A * 6/1993 Chang ..... 417/319
5,482,432 A * 1/1996 Paliwoda et al. ..... 415/168.2
6,332,842 B1 * 12/2001 Tabuchi et al. ..... 464/33
6,561,770 B2 * 5/2003 Okuda ..... 417/223
7,125,191 B2 * 10/2006 Murase et al. ..... 403/1
7,645,196 B2 * 1/2010 Brinkmann et al. ..... 464/32
2011/0150673 A1 * 6/2011 Varnoux et al. ..... 417/319

* cited by examiner

*Primary Examiner* — Charles Freay
(74) *Attorney, Agent, or Firm* — Dickinson Wright PLLC

(57) ABSTRACT

An auxiliary drive system for a water pump includes a pump housing that is mounted to an engine block. The pump housing includes an impeller shaft that passes therethrough. One end of the impeller shaft has an impeller mounted thereon, which is part of the water pump. A second end of the impeller shaft is supported by an internal bearing to allow for rotation of the impeller shaft. An external bearing is disposed around, but not in contact with the impeller shaft or the internal bearing. The external bearing is in communication with and is driven by an engine belt, such as a timing belt, which helps rotate the impeller shaft and the impeller in accordance with engine operation. A collapsible gear is disposed between and effectuates engagement of the external bearing and the impeller shaft such that if the amount of force required to be exerted by the belt exceeds a certain predetermined threshold, the collapsible gear fails and thereby prevents damage to the engine.

8 Claims, 5 Drawing Sheets

AUXILIARY SYSTEM FOR A DRIVE DEVICE

CROSS-REFERENCE TO RELATED APPLICATIONS

The present invention claims priority to U.S. Provisional Patent Application Ser. No. 61/346,977, filed May 21, 2010 and entitled "Auxiliary System for a Drive Device", which application is hereby incorporated by reference, as though set forth fully herein.

TECHNICAL FIELD

The present invention relates generally to an auxiliary system for a drive device that prevents failures of the drive system from negatively impacting an associated engine. More specifically, the present invention relates to an auxiliary system for communicating with a water pump of a high performance engine that prevents any failure of the water pump system from negatively impacting the engine.

BACKGROUND INFORMATION

As is well known, high performance engines often use water pumps as part of their engine cooling system. Water pumps typically provide circulation of the engine coolant through the cooling system, which helps prevent the engine from overheating. Water pumps are typically driven by the engine through a drive belt. Alternatively, some engines employ a timing belt to drive an associated water pump. Water pumps typically consist of a housing with an impeller shaft rotating on an internal bearing. With this configuration, a pulley is mounted on one end of the impeller shaft and an impeller is mounted on the other end of the shaft.

As is also known, a failure that can occur with these types of water pump systems is that the impeller can slide out of position and contact another structure, such as the pump housing or the engine block. This can happen as the impeller components expand and contract due to temperature changes. This contact by the impeller with either the pump housing or the engine block can cause damage to either of those structures as well as to the engine. For example, if an impeller moves out of position and contacts the pump housing, it can cause the pump to slow down due to the restricted movement, which puts stress on the pump. This stress increases the load on the timing belt which likely causes it to wear prematurely until it eventually fails unless the stress is relieved. The failure of the timing belt, which controls the reciprocation of engine valves, can cause the valves to become damaged or destroyed. The repair for this condition requires significant engine repair or an engine rebuild, which is extremely expensive.

It would thus be desirable to provide a water pump system that addressed these issues and provides improved performance.

SUMMARY OF THE INVENTION

It is therefore an advantage of the present invention to provide an auxiliary system for a drive device that minimizes damage to an associated engine in the event of failure by the drive device.

It is another advantage of the present invention to provide an auxiliary system for a water pump that separates the idler function from the pump function of the water pump such that, in the event the water pump fails, the engine will not be negatively impacted.

In accordance with the above and the other advantages of the present invention, an auxiliary system for a water pump is provided. The water pump includes a pump housing that is mounted to an engine block. The pump housing includes an impeller shaft that passes therethrough. An impeller is mounted to a first end of the impeller shaft. A second end of the impeller shaft is supported by an internal bearing. An external bearing is disposed around, but not in contact with the impeller shaft or the internal bearing. The external bearing is in communication with and is driven by an engine belt, such as a timing belt, which helps rotate the impeller shaft and the impeller in accordance with engine operation. A collapsible gear is disposed between and effectuates engagement of the external bearing and the impeller shaft such that if the amount of force required to be exerted by the belt exceeds a certain predetermined threshold, the collapsible gear fails and thereby prevents damage to the engine.

These and other features and advantages of this invention will become more apparent to those skilled in the art from the detailed description of a preferred embodiment. The drawings that accompany the detailed description are described below.

DETAILED DESCRIPTION OF PREFERRED EMBODIMENT

Figure 1:
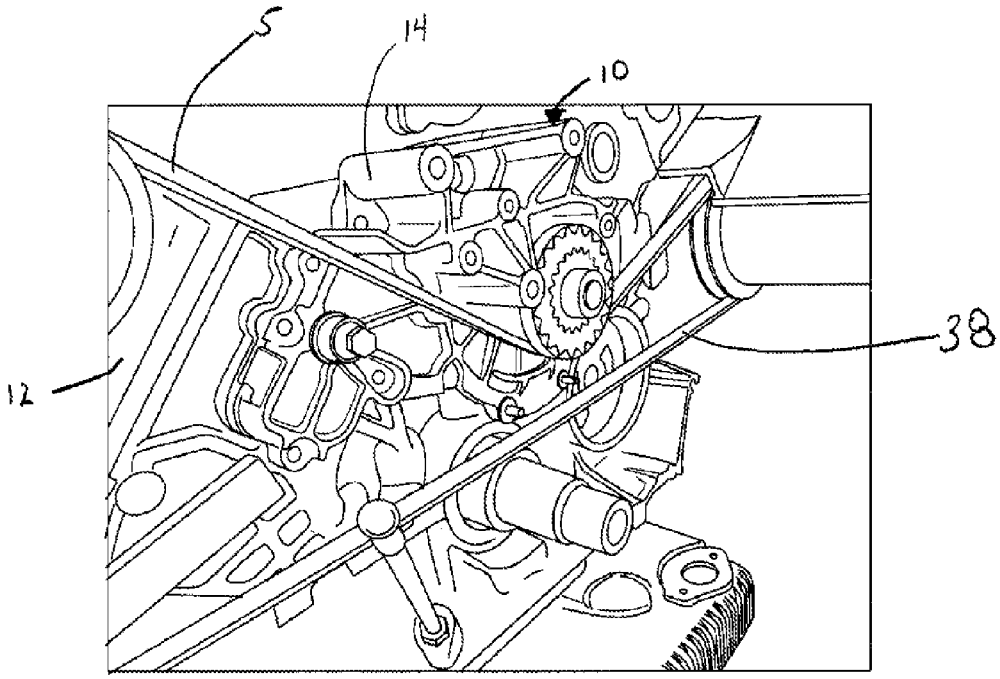
FIG. 1 is a schematic illustration of an engine and auxiliary drive device in accordance with a preferred embodiment of the present invention.
Figure 2:
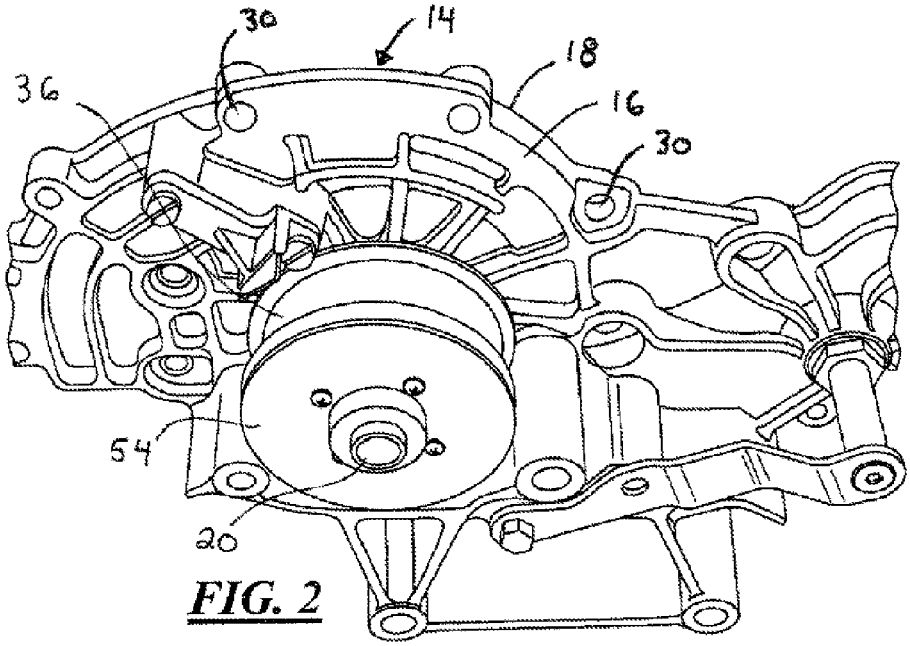
FIG. 2 is a perspective view of water pump housing with an auxiliary device mounted thereto in accordance with a preferred embodiment of the present invention.

With reference to the Figures, the present invention relates to an auxiliary drive device that can be used minimize stress on and failure of the engine in the event there is a failure of the auxiliary drive device. One potential application for the present invention is illustrated FIG. 1. As shown, the auxiliary drive device or system 10 is attached to an engine 12, such as a vehicle engine. In accordance with one preferred embodiment, the auxiliary drive device 10 is particularly applicable to engines for high performance automobiles, such as Porsche 928s, that utilize a water pump. It will be understood, however, that the auxiliary system can be utilized with other high performance automobiles, including other Porsche models as well as non-high performance automobiles. To the extent other vehicles models do not employ a water pump, it will be understood that that present invention can be incorporated into another suitable device associated with the engines of those vehicles that will separate the driving function in the event of an increased load that could cause damage to the engine. While the present invention is illustrated in connection with a vehicle engine, it will be understood that it could be employed in other non-automotive structures and applications that require rotation of a drive system, including for example, a conveyer, other pumping mechanism, or mixing devices.

Figure 6:
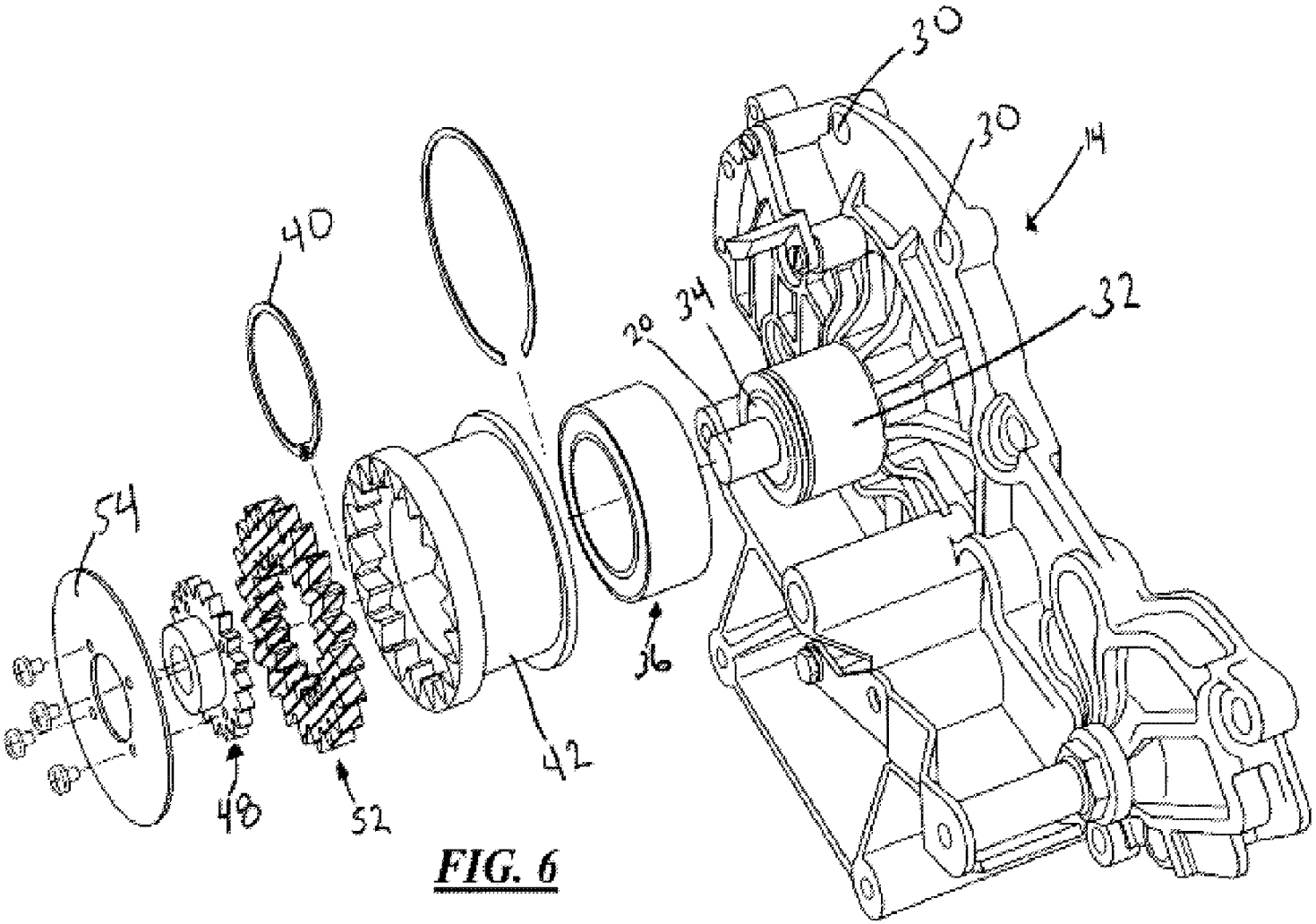
FIG. 6 is an exploded view of an auxiliary drive device for a water pump in accordance with still another preferred embodiment of the present invention.
Figure 8:
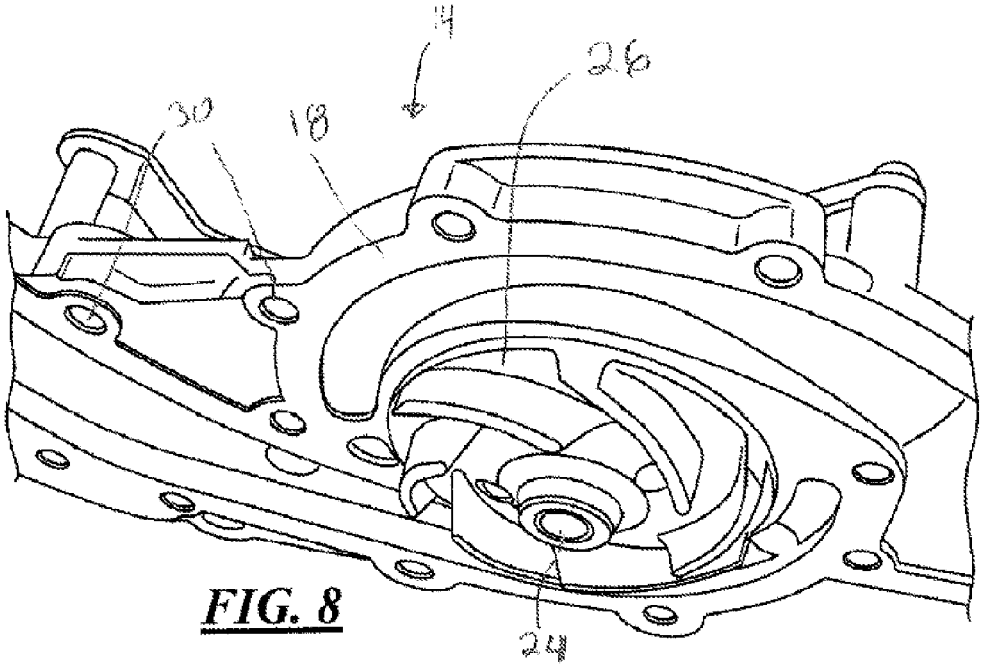
FIG. 8 is a perspective view of a water pump housing and attached impeller in accordance with the present invention.
Figure 9:
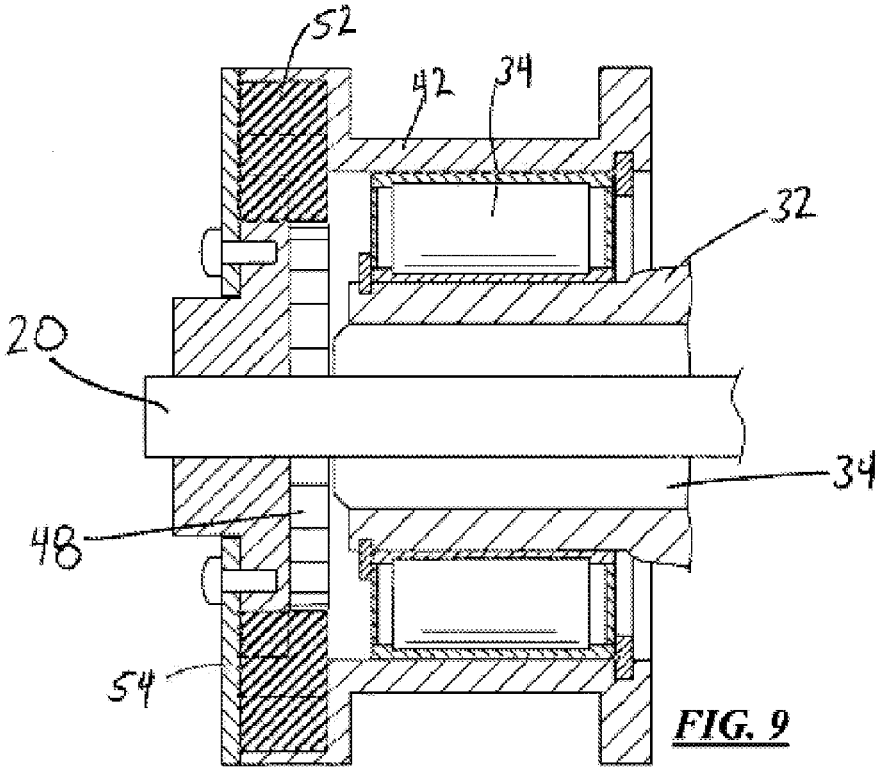
FIG. 9 is a sectional view of the auxiliary drive device in accordance with a preferred embodiment of the present invention.

With reference to the Figures, the auxiliary drive device 10 is disposed in a pump housing 14, such as a water pump housing. The pump housing 14 has an outboard side 16 and an inboard side 18. An impeller shaft 20 extends through an opening 28 in the pump housing 14 so that it communicates with both the outboard side 16 and the inboard side 18 of the pump housing 14. The impeller shaft 20 has an inboard end 22 on which is in communication with the auxiliary drive device 10. The impeller shaft 20 also has an outboard end 24 which is in communication with an impeller 26 (FIG. 6), which serves to pump water to provide engine cooling. The auxiliary drive device 10 is intended to prevent the impeller 26 of the water pump from moving and also minimize any stress on other components that movement of the impeller 26 may cause. The pump housing 14 is preferably attached to the engine via a plurality of bolt holes 30. The impeller 26 is preferably a metal structure, however the impeller 26 can be constructed of other suitable materials. However, other suitable attachment mechanisms for the pump housing 14 can be utilized. It will also be understood that the pump housing 14 can be formed of a variety of other suitable materials.

Figure 5:
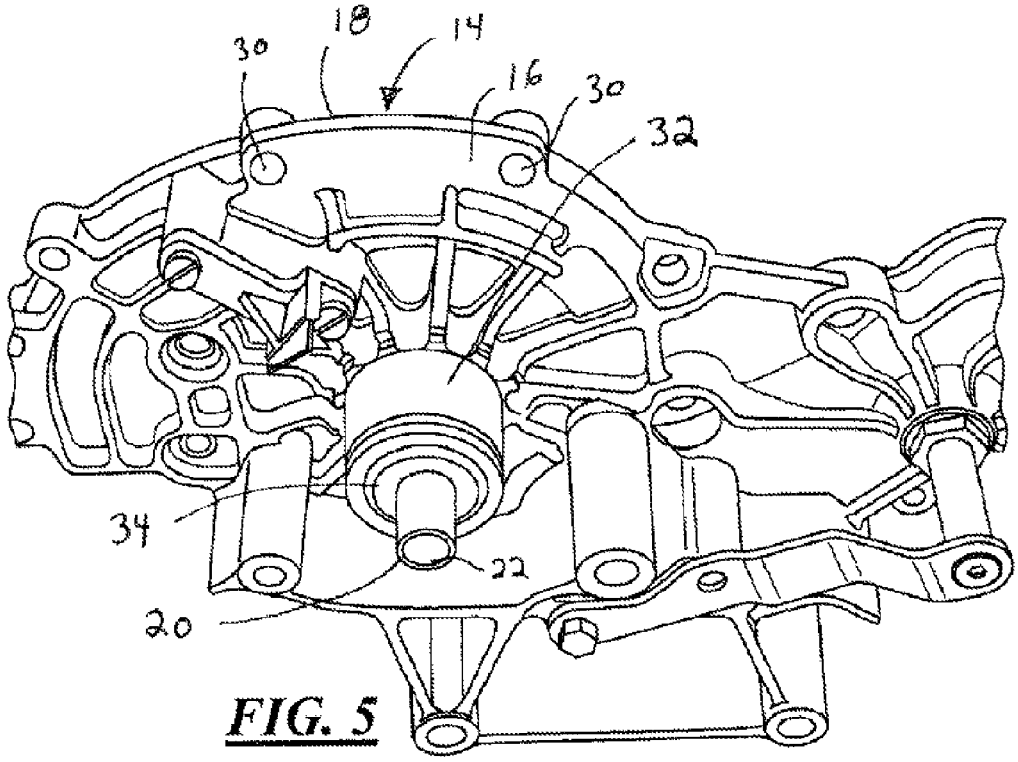
FIG. 5 is a perspective view of a water pump housing and partially assembled auxiliary drive device in accordance with a preferred embodiment of the present invention.
Figure 7:
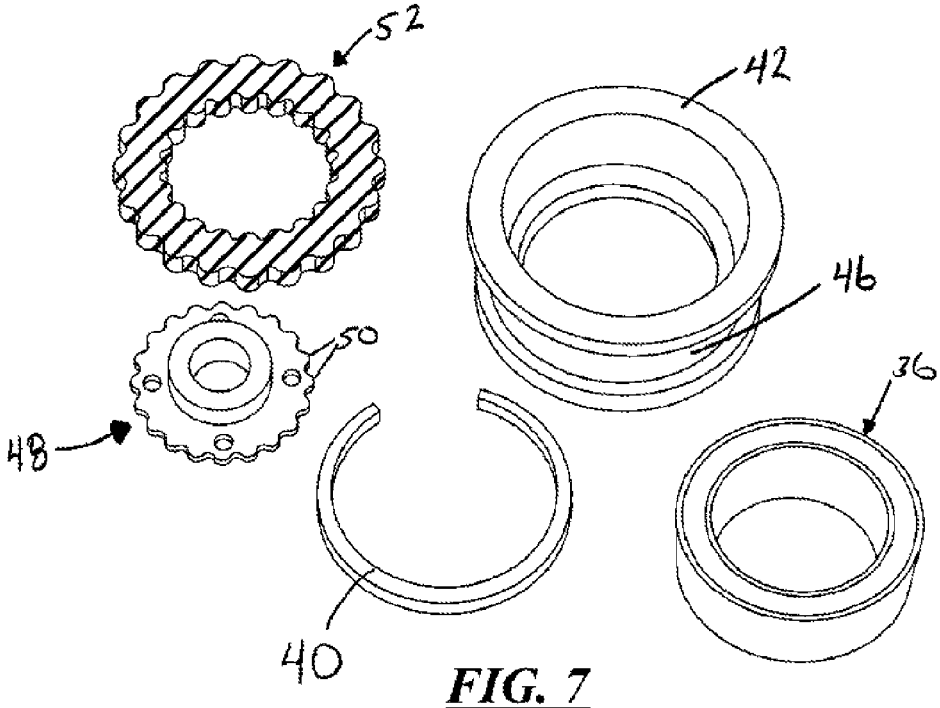
FIG. 7 schematically illustrates the components of the auxiliary device in accordance with a preferred embodiment of the present invention.

With specific reference to FIG. 5, the inboard end 22 of the impeller shaft 20 is supported within a stub housing 32 by an internal ball bearing 34. The internal ball bearing 34 is housed within the stub housing 32 and communicates with the inboard end 22 of the impeller shaft 20.

Figure 3:
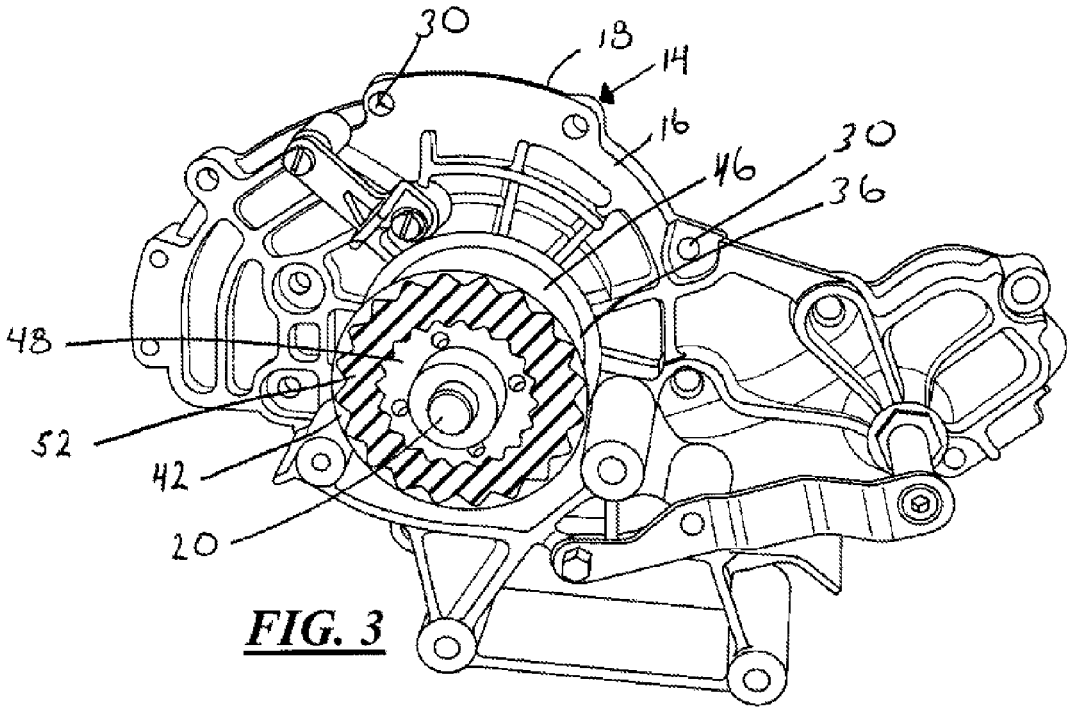
FIG. 3 is a perspective view of a water pump housing with a partially assembled auxiliary drive device in accordance with a preferred embodiment of the present invention.
Figure 4:
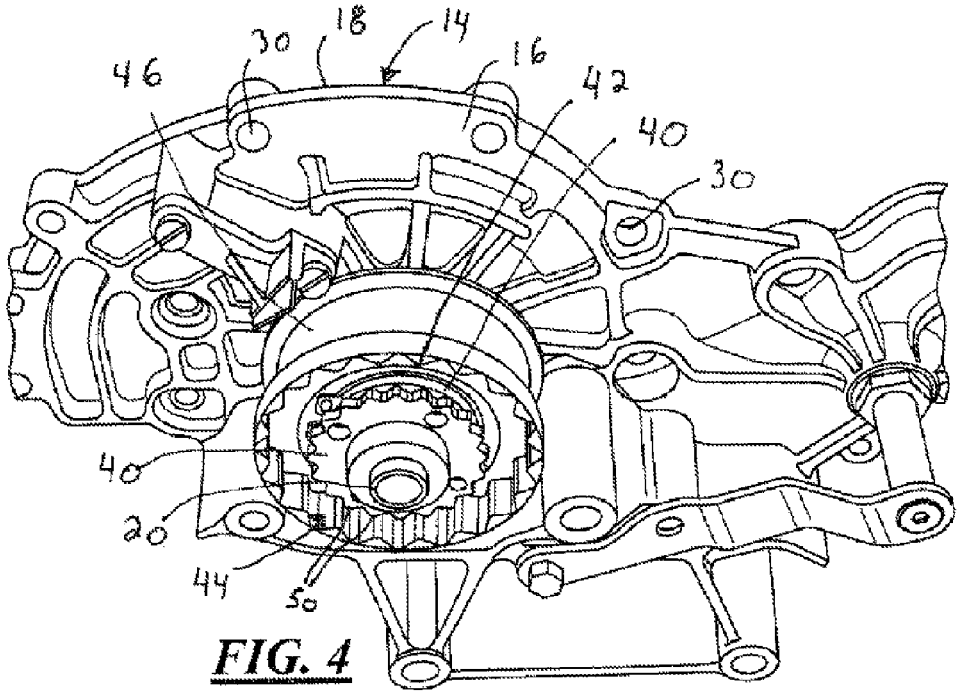
FIG. 4 is an perspective view of a water pump housing with a partially assembled auxiliary drive device in accordance with a preferred embodiment of the present invention.

The auxiliary drive device 10 is preferably disposed around the exterior of the stub housing 32 and, as shown in FIG. 3, includes an outer bearing 36 that is disposed around the stub housing 32. The outer bearing 36 is preferably a large double ball bearing. However, other suitable bearings may be employed. The outer bearing 36 is preferably configured to support the load of an associated driving belt 38 and its function. Once mounted around the stub housing 32, the outer bearing 36 is maintained in place by a retaining clip 40, such as a C-clip. In a preferred embodiment, the outer bearing 36 has an outer peripheral surface 42, which is machined to form a gear pattern 44 therein. The outer bearing 36 has an outer surface 46 that is in communication with an engine timing belt 38. The belt 38 is also in communication with engine valves in order to cause the engine timing belt to move. As will be understood, while the preferred belt is an engine timing belt 38 any other suitable belt can be utilized depending upon the type of device with which the auxiliary drive device 10 is utilized. The auxiliary drive device or system 10 includes an internal gear 50 that is mounted on the inboard end 22 of the impeller shaft 20.

As shown in FIG. 3, a collapsible gear 52 is disposed around the internal gear 48 in the space between the outer bearing 36 and the internal gear 48. The collapsible gear 52 engages both the gear pattern 44 in the outer bearing 36 and the teeth 50 of the internal gear 48 such that rotation of the outer bearing 36, as driven by the timing belt 5 causes the internal gear 48 and thus the impeller shaft 20 to rotate. The collapsible gear 52 is preferably a gear that can become disengaged from communication with either the teeth 50 of the internal gear 48 and/or the gear pattern 44 formed in the outer peripheral surface 42 upon application of a force of a predetermined level. The collapsible gear 52 is preferably formed of a rubber material, however, it can be formed of other suitable materials. In one embodiment, the collapsible gear 52 is designed to fail if the amount of torque required to spin or rotate the internal gear 48 exceeds a predetermined limit. For example, if the amount of torque required to rotate the internal gear 48 is approximately 60 in/lbs, the collapsible gear 52 can be designed to have a fail point of about 120 in/lbs. The collapsible gear 52 is preferably formed from a thermoplastic rubber, however, it can be constructed of other materials in accordance with the present invention. It will also be understood that the clearances and amount of gear tooth engagement determines the amount of force required to break away and it will also be understood that these can vary to change the amount of force to place the water pump in idling mode.

An end cap 54 is preferably secured to the internal gear 48 to provide a cover for the internal components of the auxiliary drive system 10. The end cap 54 can be removed as necessary to provide access to the internal components of the auxiliary system 10. As will be appreciated, the end cap 54 can obviously be secured to other structures.

The inclusion of the outer bearing 36 separates direct contact between the inner bearing 34, the impeller shaft 22 and the impeller 36 such that if the water pump seizes, the timing belt 5 is not affected. This isolation prevents damages to the engine valves as well as other components of the engine 12 in the event of any added stress due to a failure with the water pump. Accordingly, as can be seen, the disclosed auxiliary system 10 separates the idler function from the pump function of the water pump.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. An auxiliary drive system for use with a water pump for a high performance vehicle engine comprising:

a pump housing that is adaptable to be mounted to the vehicle engine;

a shaft that passes through said pump housing and has a first end and a second end;

an impeller rotatably mounted on said first end of said shaft;

a first bearing rotatably supporting said second end of said shaft;

a second bearing in communication with said shaft and said first bearing;

a drive belt in communication with said second bearing to effectuate rotation thereof; and a collapsible gear having an outer peripheral surface containing a plurality of outer teeth extending radially outwardly and an inner surface containing a plurality of inner teeth extending radially inwardly, and said outer teeth of said collapsible gear in driving communication with said drive belt and said inner teeth of said collapsible gear in communication with said shaft to effectuate rotation of said shaft;

whereby upon application of a force above a predetermined threshold, said collapsible gear disengages from said drive belt and/or said shaft.

2. The auxiliary drive system as recited in claim 1, wherein said first bearing is disposed within a stub housing formed in said pump housing.

3. The auxiliary drive system as recited in claim 2, wherein said second bearing is disposed around said stub housing.

4. The auxiliary drive system as recited in claim 1, further comprising:

an internal gear that is disposed on said second end of said shaft.

5. The auxiliary drive system as recited in claim 4, wherein said second bearing has a plurality of teeth formed on an inner surface therein that engage said plurality of outer teeth on said collapsible gear.

6. The auxiliary drive system as recited in claim 4, wherein said collapsible gear has a plurality of inner teeth that engage said internal gear.

7. The auxiliary drive system as recited in claim 1, wherein said collapsible gear is formed of a thermoplastic.

8. The auxiliary drive system as recited in claim 1, further comprising:

an end cap that is disposed over said collapsible gear.

* * * * *